US007081274B2

(12) United States Patent
Nishikawa et al.

(10) Patent No.: US 7,081,274 B2
(45) Date of Patent: Jul. 25, 2006

(54) METHOD FOR PRODUCING SPARK PLUG

(75) Inventors: Kenichi Nishikawa, Bisai (JP); Makoto Sugimoto, Nagoya (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 827 days.

(21) Appl. No.: 10/179,888

(22) Filed: Jun. 26, 2002

(65) Prior Publication Data

US 2003/0051341 A1 Mar. 20, 2003

(30) Foreign Application Priority Data

Jun. 26, 2001 (JP) ..... P.2001-193094

(51) Int. Cl.
*B05D 3/02* (2006.01)

(52) U.S. Cl. ..... 427/376.2; 427/397.7; 445/7; 313/118

(58) Field of Classification Search ..... 427/376.2, 427/397.7; 313/118; 445/7
See application file for complete search history.

(56) References Cited

U.S. PATENT DOCUMENTS 6,166,481 A * 12/2000 Knapp et al. ..... 313/141
6,274,971 B1 8/2001 Sugimoto et al.
6,492,289 B1 12/2002 Suzuki et al.
2002/0036450 A1* 3/2002 Nishikawa ..... 313/118

FOREIGN PATENT DOCUMENTS

| | | |
|---|---|---|
| JP | B 49 35322 | 9/1974 |
| JP | A 10-236845 | 9/1998 |
| JP | 11-43351 | 2/1999 |
| JP | 11-106234 | 4/1999 |
| JP | B 2959404 | 7/1999 |
| JP | A 2000 48931 | 2/2000 |
| JP | A 2000 313681 | 11/2000 |
| JP | A 2001-39733 | 2/2001 |

* cited by examiner

*Primary Examiner*—Kirsten Jolley
(74) *Attorney, Agent, or Firm*—Morgan, Lewis & Bockius LLP

(57) ABSTRACT

A method for producing a spark plug, the spark plug comprising a center electrode, a metal shell and an alumina ceramic insulator disposed between the center electrode and the metal shell, wherein at least part of the surface of the insulator is covered with a glaze layer, the method comprising the steps of: preparing a plurality of kinds of element glaze powders wherein each kind of the element glaze powders has a different dilatometric softening point and a different linear expansion coefficient compared to other kinds of element glaze powders; coating a surface of the insulator with the plurality of kinds of element glaze powders so as to form a glaze powder layer; and baking the glaze powder layer to the surface of the insulator so as to form the glaze layer by heating the glaze powder layer.

21 Claims, 5 Drawing Sheets

METHOD FOR PRODUCING SPARK PLUG

FIELD OF THE INVENTION

This invention relates to a spark plug.

BACKGROUND OF THE INVENTION

A spark plug used for ignition of an internal engine of such as automobiles generally comprises a metal shell to which a ground electrode is fixed, an insulator made of alumina ceramics, and a center electrode which is disposed inside the insulator. The insulator projects from the rear opening of the metal shell in the axial direction. A terminal metal fixture is inserted into the projecting part of the insulator and is connected to the center electrode via a conductive glass seal layer which is formed by a glass sealing procedure or a resistor. A high voltage is applied to the terminal metal fixture to cause a spark over the gap between the ground electrode and the center electrode.

Under some combined conditions, for example, at an increased spark plug temperature and an increased environmental humidity, it may happen that high voltage application fails to cause a spark over the gap but, instead, a discharged called as a flashover occurs between the terminal metal fixture and the metal shell, going around the projecting insulator. Primarily for the purpose of avoiding the flashover, most of commonly used spark plugs have a glaze layer on the surface of the insulator. The glaze layer also serves to smoothen the insulator surface thereby preventing contamination and to enhance the chemical or mechanical strength of the insulator.

In the case of the alumina insulator for the spark plug, such a glaze of lead silicate glass has conventionally been used for heightening fluidity when baking the glaze, where silicate glass is mixed with a relatively large amount of PbO to lower a dilatometric softening point. In recent years, however, with a globally increasing concern about environmental conservation, glazes containing Pb have been losing acceptance. In the automobile industry, for instance, where spark plugs find a huge demand, it has been a subject of study to phase out Pb glazes in a future, taking into consideration the adverse influences of waste spark plugs on the environment.

However, leadless borosilicate glass- or alkaline borosilicate glass-based glazes have been studied as substitutes for the conventional Pb glazes, but they inevitably have inconveniences such as a high glass transition or an insufficient insulation resistance. For solving this problem, Japanese Patent Laid Open No. 106234/1999 discloses respective compositions of leadless glazes having the improved insulation resistance by joint addition of alkaline component.

SUMMARY OF THE INVENTION

However No. 106234/1999 refers to the improved insulation resistance by joint addition of alkaline component in the glaze containing Si or B as vitreous skeletons, but does not pay sufficient attention to cancellation of difference in the linear expansion coefficient from the alumina based ceramics as a ceramics composing the insulator, and a level of the improved insulation resistance is not necessarily enough. In a case of the glaze not especially containing Pb, for lessening the difference in the linear expansion coefficient from the alumina based ceramics, it is useful to increase oxide components as Si or Zn, but if employing such a composition, the dilatometric softening point of the glaze increases, and the fluidity when baking the glaze easily lacks. As a result, air bubbles remain in the glaze layer, resulting in inconvenience that chipping resistance is short when mechanical or thermal shocks are applied. However, a large change of the glaze composition for adjusting the difference in the linear expansion coefficient in turn invites spoil of facility of the glaze (for example, voltage characteristic), and turns over root and branch.

It is accordingly an object of the invention to provide a method of producing a spark plug in which a glaze can be baked at relatively low temperature less to cause air bubbles to remain, and in turn a glaze layer is excellent in chipping resistance.

The invention relates to a method of producing a sparkplug, wherein an insulator of alumina based ceramics is disposed between a center electrode and a metal shell, and a glaze layer is formed to cover at least part of the surface of the insulator, and for solving the above mentioned problem, characterized by comprising the steps of a process of producing a plurality of kinds of element glaze powders where dilatometric softening points and linear expansion coefficient are different one another, a process of forming a glaze powder layer by coating the surface of the insulator with the plurality of kinds of element glaze powders, and a process of baking the glaze powder layer onto the surface of the insulator by heating the insulator so as to form the glaze layer.

In case of forming the glaze layer having a linear expansion coefficient to be obtained by using a single glaze powder (referred to as "non-adjusted glaze powder" hereafter) having the same composition as an average composition of a final glaze layer as shown in FIG. 2A, as a result of selecting the composition preferentially adjusting the linear expansion coefficient, the dilatometric softening point of the glaze goes up, so that the fluidity at glaze-baking especially lacks, and air bubbles might be caused to remain in the glaze layer. Therefore, in the invention, a plurality of glaze compositions where dilatometric softening points and linear expansion coefficient are different one another, are rendered to be respectively element glaze powders, and for adjusting the linear expansion coefficient of the glaze layer to be finally obtained to coincide to a predetermined value, the adjusted glaze powders are produced by mixing the plurality of glaze powders and deposited on the insulator and baked so as to obtain the glaze layer.

In case of mixing to use the plurality of element glaze powders, among the linear expansion coefficient, a maximum is defined as $\alpha max$ and a minimum is defined as $\alpha min$, and thus the linear expansion coefficient of a final glaze layer is inevitably a middle value between $\alpha max$ and $\alpha min$. In other words, when an objective value of the linear expansion coefficient is $\alpha m$, if using the adjusted glaze powders mixed at an appropriate ratio with the element glaze powders whose linear expansion coefficient are larger and smaller than $\alpha m$, the glaze layer having a linear expansion coefficient to be targeted at is obtained. In this case, at least one kind of the element glaze powders mixed in the adjusted glaze powders can be determined to be lower than the dilatometric softening point of the above mentioned non-adjusted glaze powders, and therefore, as shown in FIG. 2B, the element glaze powder (in the drawing, the first element glaze powder) is preferentially softened, and the fluidity can be heightened as a whole when baking the glaze. Consequently, air bubbles are less to occur in the glaze layer, and the chipping resistance of the glaze layer can be largely improved. In particular, the above mentioned effect is particularly remarkably exhibited when such a glaze layer is formed where the dilatometric softening point of the non-adjusted glaze is easy to go up, and the Pb containing rate is 1 mol % or less in terms of PbO.

Since the composition of the glaze has the vitreous skeleton being main of $SiO_2$, the containing rate of the Si compound derived therefrom gives large influences to the dilatometric softening point of the glaze composition and the values of the liner expansion coefficient. On the other hand, ZnO is excellent in lowering the dilatometric softening point of the glaze by appropriately mixing it, reducing the liner expansion coefficient of the glaze, and lessening the difference of the liner expansion coefficient from the insulator composed of the alumina based ceramics. Accordingly, in the producing method of the invention, in view that the fluidity improved when baking the glaze and the effect of adjusting the liner expansion coefficient are made compatible, it is desirable that the plurality of element glaze powders used to the adjusted glaze powders comprise the main glaze composition and the sub-glaze composition which are different in the containing rate of the Si component and/or the containing rate of the Zn component each other, and the sub-glaze composition has the coefficient of linear expansion lower than that of the main glaze composition.

For heightening the chipping resistance of the glaze layer, it is desirable that the number of air bubbles observed in a range of 100 μm×100 μm is less than 50 in the surface of the produced glaze layer.

In order to avoid inconveniences causing defects as the crazing in the glaze layer, it is desirable to in advance reduce the difference of the liner expansion coefficient from the insulator made of the alumina based ceramics to the most by adjusting the composition of the adjusted glaze powder powders (that is, the respective compositions of the element glaze powder powders and the mixing ratios therewith) in such a manner that the liner expansion coefficient of the glaze layer (the average value) is $85\times10^{-7}$/° C. On the other hand, if the liner expansion coefficient of the glaze layer is made less than $50\times10^{-7}$/° C., it is difficult to determine the composition of the adjusted glaze powder powders such that the fluidity at glaze-baking is sufficiently improved.

Further explanation will be made to specific examples of the element glaze powders.

At first, the following composition is prepared as the main glaze composition playing a role of the main of the glaze layer (50 weight % or more in this description). That is, the main glaze composition respectively contains Si component 25 to 45 mol % in terms of $SiO_2$; B component 20 to 40 mol % in terms of $B_2O_3$; Zn component 5 to 25 mol % in terms of ZnO; Ba and/or Sr components 0.5 to 15 mol % in total in terms of BaO or SrO; and alkaline metal components of 5 to 10 mol % in total of one kind or more of Na in terms $Na_2O$, K in terms of $K_2O$ and Li in terms of $Li_2O$.

Any one of the followings is prepared as a substance having a lower linear expansion coefficient than that of the main glaze composition and higher dilatometric softening point than that thereof.

(First Sub-glaze Composition)

respectively containing Si component 60 to 80 mol % in terms of $SiO_2$; B component 10 to 25 mol % in terms of $B_2O_3$; and alkaline metal components of 4 to 8 mol % in total of one kind or more of Na in terms $Na_2O$, K in terms of $K_2O$ and Li in terms of $Li_2O$; and (Second Sub-glaze Composition)

respectively containing Zn component 45 to 65 mol % in terms of ZnO; and Ba component 30 to 50 mol % in terms of BaO.

The element glaze powder containing the main glaze composition (referred to as "main element glaze powder" hereafter) is mixed with the element glaze powder of the sub-glaze composition (referred to as "sub-element glaze powder" hereafter). Thus, the adjusted glaze powder is produced. By the way, it is sufficient to use any one kind or two kinds of the first sub-glaze composition and the second sub-glaze composition. In addition, it is also possible to use the compositions of the main element glaze powder, the first and second sub-glaze powder in association of plural and different compositions within allowed ranges.

In the above examples, for effecting the compatibility with environmental problems, the glaze layer finally obtained contains, as mentioned above, Pb component 1.0 mol % or less (preferably 0.1 mol % or less, and more preferably substantially no presence) in terms of PbO. While lowering the Pb content in the main glaze composition, the above mentioned particular compositions are selected for providing the insulation performance, optimizing the glaze baking temperature and securing a good glaze-baked finish. In the existing glaze, the Pb component plays an important part as to adjustment of the dilatometric softening point (practically, appropriately lowering the dilatometric softening point of the glaze and securing the fluidity when baking the glaze) but in the leadless glaze, the B component ($B_2O_3$) and the alkaline metal component have a deep relation with adjustment of the dilatometric softening point. The B component has a particularly convenient range for improving the glaze baking finish in relation with the content of the Si component, and if selecting this range, the fluidity when baking the glaze may be secured, and in turn the baking of the glaze is possible at relatively low temperatures, the glaze layer having an excellent and smooth baked surface is available.

There might be cases that the Si component is difficult to secure the sufficient insulation property if being less than 25 mol %, and is difficult to bake the glaze if being more than 45 mol %, on the other hand, if the B component is less than 20 mol %, the dilatometric softening point of the glaze rises and the baking of the glaze is difficult. If the B component is more than 40 mol %, crimping is easily created in the glaze. If the Zn component is less than 5 mol %, coefficient of thermal expansion of the glaze layer is too large, and defects as crimping easily occurs in the glaze layer. Further, the Zn component works to lower the dilatometric softening point of the glaze, an if it is short, the glaze-baking is difficult. On the other hand, if the Zn component exceeds 25 mol %, opacity is ready for issuing owing to devitrification.

The Ba or Sr components contribute to heightening of the insulation property of the glaze layer and is effective to increasing of the strength. If the total amount is less than 0.5 mol %, the insulation property of the glaze layer goes down, and the anti-flashover might be spoiled. Being more than 20 mol %, the thermal expansion coefficient of the glaze layer is too high, defects such as crazing easily occur in the glaze layer. In addition, the opacity easily occurs in the glaze layer. From the viewpoint of heightening the insulation property and adjusting the thermal expansion coefficient, the total amount of Ba and Sr is desirably determined to be 0.5 to 10 mol %. Either or both of the Ba and Sr component may be contained, but the Ba component is advantageously cheaper in a cost of a raw material.

The total amount of the Zn component and Ba and/or Sr components is desirably 8 to 30 mol % in terms of oxide. If the total amount exceeds 30 mol %, the glaze layer will be slightly opaque. For example, on the outer surface of the insulator, visual information such as letters, figures or product numbers are printed and baked with color glazes for identifying makers and others, and owing to the slight opaqueness, the printed visual information is sometimes illegible. Or, if being less than 8 mol %, the dilatometric softening point exceedingly goes up to make the glaze baking difficult and cause bad external appearance. Thus, the total amount is more desirably 10 to 20 mol %.

Desirably, the total containing amount of alkaline metal components is 5 to 10 mol %. Being less than 5 mol %, the dilatometric softening point of the glaze goes up, and the glaze-baking might be impossible. On the other hand, being more than 10 mol %, the insulation property of the glaze goes down to probably spoil the anti-flashover. It is desirable to set the rate of the K component of the alkaline metal components of Na, K and Li in the mol % in terms of oxide to be $$0.4 \leqq K/(Na+K+Li) \leqq 0.8.$$

Thereby, the effect of improving the insulation property is more heightened. Only, if the value of K/(Na+K+Li) is less than 0.4, the effect thereof might be insufficient.

On the other hand, the value of K/(Na+K+Li) is set to be 0.8 or less for securing the fluidity at the glaze-baking, and signifies that the alkaline metal component other K is jointly added in the range of the rest being 0.2 or more (≦0.6). By the way, the value of K/(Na+K+Li) is desirably adjusted within the range of 0.5 to 0.7.

Among the alkaline components, the Li component is preferred to be contained in order to realize the effect of adding in joint alkaline components for increasing the insulation property, and in order to adjust the heat expansion coefficient of the glaze layer, to secure the fluidity when baking the glaze, and further to increase the mechanical strength. It is preferable that the Li component is contained in the mol amount in terms of oxide in the following range:

$$0.2 \leqq Li/(Na+K+Li) \leqq 0.5.$$

If the rate of Li is less than 0.2, the heat expansion coefficient becomes too large as compared with the alumina substrate. As a result, the crazing may be easily produced to make the finished glaze-baking surface insufficient. On the other hand, if the rate of Li component exceeds 0.5, because the Li ion is of a comparatively high degree of immigration among the alkaline metal ions, this may give an adverse influence to the insulation property of the glaze layer. It is preferable that the value of Li/(Na+K+Li) is adjusted in the range of 0.3 to 0.45. Incidentally, for more heightening the insulation property improving effect by the joint addition of the alkaline metal components, other alkaline metal components following a third component as Na can be compounded within ranges where a total containing amount of the alkaline metal components does not exceed as spoiling electric conductivity, and especially desirably the three components of Na, K and Li are all contained.

The above mentioned glaze composition can secure the fluidity at glaze-baking under a better condition by containing one kind or more of Mo, W, Ni, Co, Fe and Mn 0.5 to 5 mol % in total in terms of $MoO_3$, $WO_3$, $Ni_3O_4$, $Co_3O_4$, $Fe_2O_3$ and $MnO_2$, respectively. If being less than 0.5mol %, it is insufficient to accomplish an enough effect which improves the fluidity at glaze-baking, while being more than 5 mol %, the dilatometric softening point of the glaze exceedingly goes up, and the glaze-baking is difficult or impossible.

Further, it is possible to contain one kind or more of Ti, Zr and Hf 0.5 to 5 mol % in total in terms of ZrO2, TiO2 and HfO2. By containing Ti, Zr or Hf, a water resistance is improved. As to the Zr or Hf components, the improved effect of the water resistance of the glaze layer is more noticeable in comparison with the Ti component. By the way, "the water resistance is good" is meant that if, for example, a powder like raw material of the glaze is mixed together with a solvent as water and is left as a glaze slurry for a long time, such inconvenience is difficult to occur as increasing a viscosity of the glaze slurry owing to elusion of the components. As a result, in case of coating the insulator with the glaze slurry, optimization of a coating thickness is easy and unevenness in thickness is reduced. Subsequently, said optimization and said reduction can be effectively attained. If being less than 0.2 mol %, the effect is poor, and if being more than 5 mol %, the glaze layer is ready for devitrification.

The composition of the main glaze powder has the low dilatometric softening point and the effect of heightening the fluidity of the glaze when baking the glaze, since the Si content is controlled to be low. However, if only Si is concerned, the linear expansion coefficient is too large, and the difference of the linear expansion coefficient from the insulator made of the alumina based ceramic is large, so that defects as crazing easily occurs in the produced glaze layer. Therefore, by appropriately compounding the sub-element glaze powder having the small linear expansion coefficient, the linear expansion coefficient of the glaze can be lowered and defects can be avoided from generation in the glaze layer. Further, since the sub-element glaze powders contain high Si and Zn, the dilatometric softening point is fairly higher than that of the main element glaze powders. Accordingly, when the main element glaze powder is preferentially fused at glaze-baking, it is delayed in going into a molten phase of the sub-element glaze powder, so that a time when a fused phase high in the fluidity is formed is extended. Consequently, air bubbles held among glaze powders are accelerated to get out, and the glaze layer excellent in the chipping resistance is made available.

In one embodiment, the method for producing a spark plug comprises a glaze-baking step, wherein the glaze layer has at least part of the second element glaze powder remaining incompletely fused.

The mixing amount of the sub-element glaze powder in the adjusted glaze powders is desirably adjusted to be in a range of 5 to 30 weight %. Being less than 5 weight %, the linear expansion coefficient of the produced glaze layer is too large, and the difference of the linear expansion coefficient from the insulator made of the alumina based ceramic is large, so that defects as crazing easily occurs in the produced glaze layer. The above mentioned effect by mixing the sub-element glaze powder cannot be accomplished, and if exceeding 30 weight %, the fluidity at the glaze-baking is worsened, so that the effect of removing air bubbles cannot be fully exhibited.

In case the main glaze composition as mentioned above is employed, the linear expansion coefficient preferably ranges $50\times10^{-7}$/° C. to $80\times10^{-7}$/° C. Accordingly, for the sub-glaze composition, it is necessary to employ a linear expansion coefficient smaller than said range, and if employing a linear expansion coefficient less than $50\times10^{-7}$/° C., this is desirable in view of reducing average linear expansion coefficient in the produced glaze layer and restraining occurrence of defects as crimping. By the way, for the sub-glaze composition, if employing a linear expansion coefficient having difference of the linear expansion coefficient from the main glaze composition being $50\times10^{-7}$/° C. to $85\times10^{-7}$/° C., this is desirable in view of more distinguishing the above mentioned effects.

In the first sub-glaze composition, if the Si component is less than 60 mol %, the B component exceeds 25 mol %, or the total amount of the alkaline metal components is more than 8 mol %, the linear expansion coefficient of the finally produced glaze layer cannot be fully lowered, and defects as crazing are easy to occur in the glaze layer. In contrast, if the Si component is more than 80 mol %, or the B component is less than 10 mol %, or the total amount of the alkaline metal components is less than 4 mol %, the transparency of the glaze layer is easily spoiled, and the fluidity of the fused phase occurring at glaze-baking is worsened depending on the mixing amount, so that the effect of the invention cannot be fully exhibited.

On the other hand, in the second sub-glaze composition, if the Zn component is less than 45 mol %, or the B component exceeds 50 mol %, the linear expansion coefficient of the finally produced glaze layer cannot be fully lowered, and defects as crazing are easy to occur in the glaze layer. In contrast, if the Zn component is more than 65 mol %, or the B component is less than 30 mol %, the transparency of the glaze layer is easily spoiled, the fluidity of the fused phase occurring at the glaze-baking is worsened depending on the mixing amount, so that the effect of the invention cannot be fully exhibited.

Figure 2A:
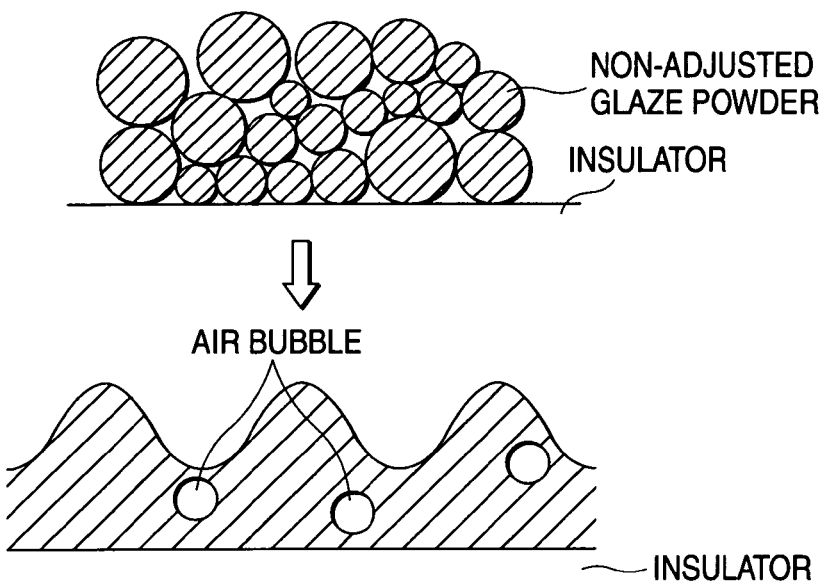
Figure 2B:
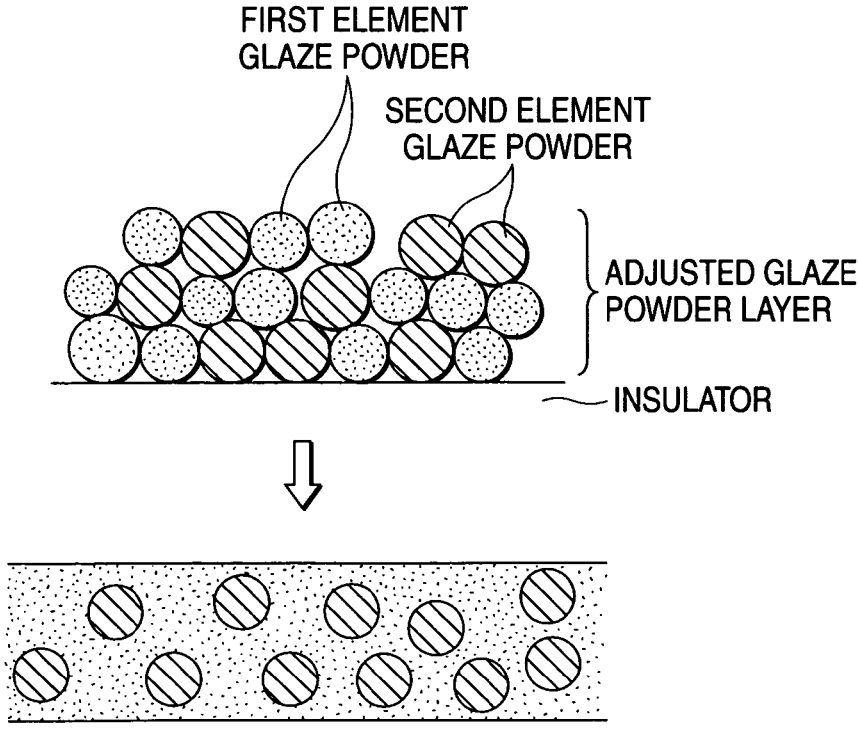

Process explaining views showing one example of a method of producing the spark plug according to the invention;

FIGS. 2A and 2B

Work explaining views of the method of producing the spark plug according to the invention;

FIG. 3

A vertically cross sectional view showing one example of the spark plug to be produced by the invention;

FIG. 4

Figure 5A:
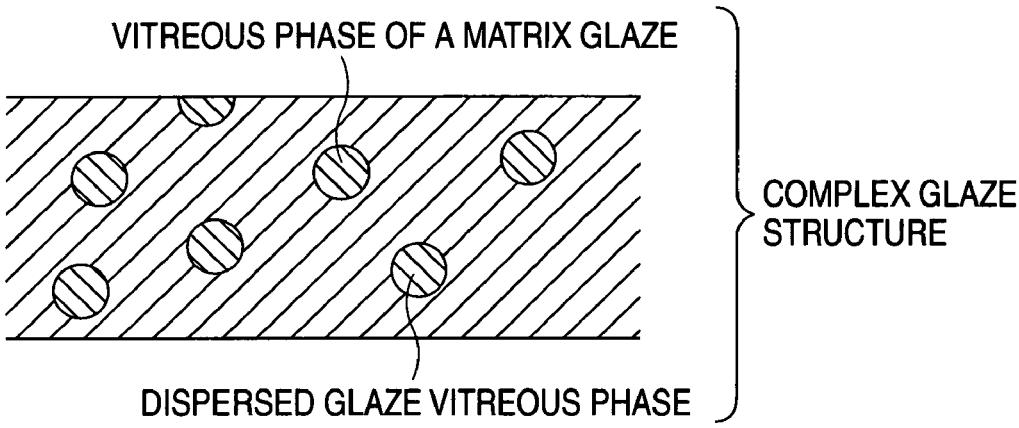
Figure 5B:
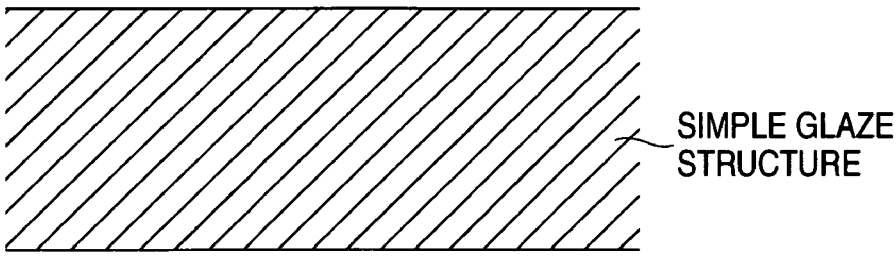

An explanatory view showing an external appearance of the insulator after glaze-baking; and FIGS. 5A and 5B Schematic views showing examples of the glaze structures.

DETAILED DESCRIPTION OF THE INVENTION

Figure 3:
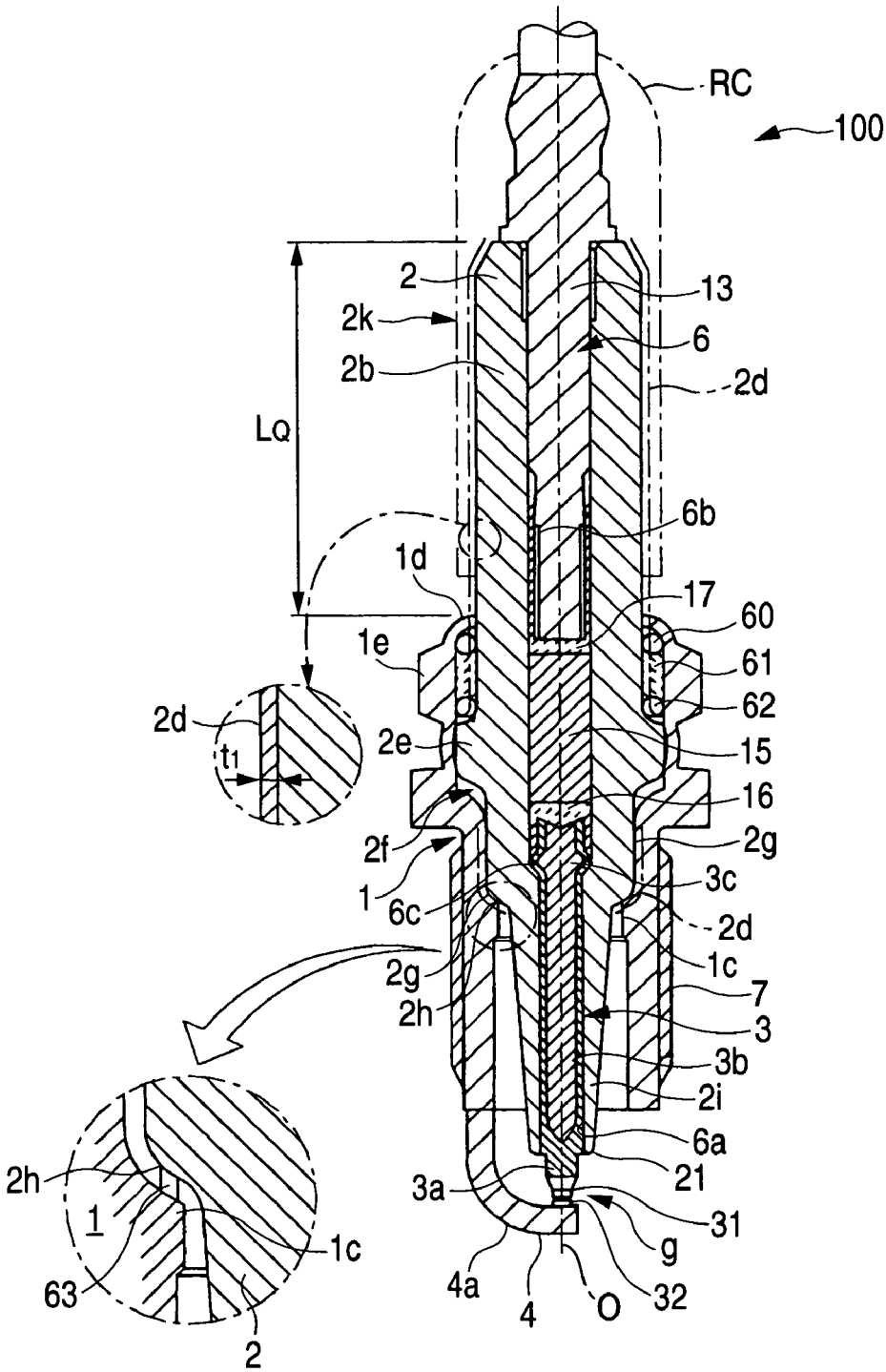

Modes for carrying out the invention will be explained with reference to the accompanying drawings showing embodiments. FIG. 3 shows an example of the spark plug applied by the invention. The spark plug 100 has a cylindrical metal shell 1, an insulator 2 fitted in the inside of the metal shell 1 with its tip 21 projecting from the front end of the metal shell 1, a center electrode 3 disposed inside the insulator 2 with its ignition part 31 of a precious metal formed at the tip thereof, and a ground electrode 4 with its one end welded to the metal shell 1 and the other end bent inward such that a side of this end may face the tip of the center electrode 3. The ground electrode 4 has an ignition part 32 which faces the ignition part 31 to make a spark gap g between the facing ignition parts 32.

The metal shell 1 is formed to be cylindrical of a metal such as a low carbon steel. It has a thread 7 and a hexagonal nut portion 1*e* therearound for screwing the spark plug 100 into an engine block (not shown).

The insulator 2 has a through-hole 6 penetrating in the axial direction. A terminal fixture 13 is fixedly inserted in one end of the through-hole 6, and the center electrode 3 is fixedly inserted in the other end. A resistor 15 is disposed in the through-hole 6 between the terminal metal fixture 13 and the center electrode 3. The resistor 15 is electrically connected at both ends thereof to the center electrode 3 and the terminal metal fixture 13 via the conductive glass seal layers 16 and 17, respectively.

The insulator 2 has a through-hole 6 for inserting the center electrode 3 along in the axial direction thereof, and is as a whole composed of an alumina based ceramic sintered body. The insulator 2 has a projection 2*e* projecting outwardly, e.g., flange-like on its periphery at the middle part in the axial direction, a rear portion 2*b* whose outer diameter is smaller than the projecting portion 2*e*, a first front portion 2*g* in front of the projecting portion 2*e*, whose outer diameter is smaller than the projecting portion 2*e*, and a second front portion 2*i* in front of the first front portion 2*g*, whose outer diameter is smaller than the first front portion 2*g*. The rear end part of the rear portion 2*b* is not formed with corrugations. The first front portion 2*g* is almost cylindrical, while the second front portion 2*i* is tapered toward the tip 21.

On the other hand, the center electrode 3 has a smaller diameter than that of the resistor 15. The through-hole 6 of the insulator 2 is divided into a first portion 6*a* (front portion) having a circular cross section in which the center electrode 3 is fitted and a second portion 6*b* (rear portion) having a circular cross section with a larger diameter than that of the first portion 6*a*. The terminal metal fixture 13 and the resistor 15 are disposed in the second portion 6*b*, and the center electrode 3 is inserted in the first portion 6*a*. The center electrode 3 has an outward projection 3*c* around its periphery near the rear end thereof, with which it is fixed to the electrode. A first portion 6*a* and a second portion 6*b* of the through-hole 6 are connected each other in the first front portion 2*g*, and at the connecting part, a projection receiving face 6*c* is tapered or rounded for receiving the projection 3*c* for fixing the center electrode 3.

The first front portion 2*g* and the second front portion 2*i* of the insulator 2 connect at a connecting part 2*h*, where a level difference is formed on the outer surface of the insulator 2. The metal shell 1 has a projection 1*c* on its inner wall at the position meeting the connecting part 2*h* so that the connecting part 2*h* fits the projection 1*c* via a gasket ring 63 thereby to prevent slipping in the axial direction. A gasket ring 62 is disposed between the inner wall of the metal shell 1 and the outer side of the insulator 2 at the rear of the flange-like projecting portion 2*e*, and a gasket ring 60 is provided in the rear of the gasket ring 62. The space between the two gaskets 60 and 62 is filled with a filler 61 such as talc. The insulator 2 is inserted into the metal shell 1 toward the front end thereof, and under this condition, the rear opening edge of the metal shell 1 is pressed inward the gasket 60 to form a crimping portion 1*d*, and the metal shell 1 is secured to the insulator 2.

Figure 4:
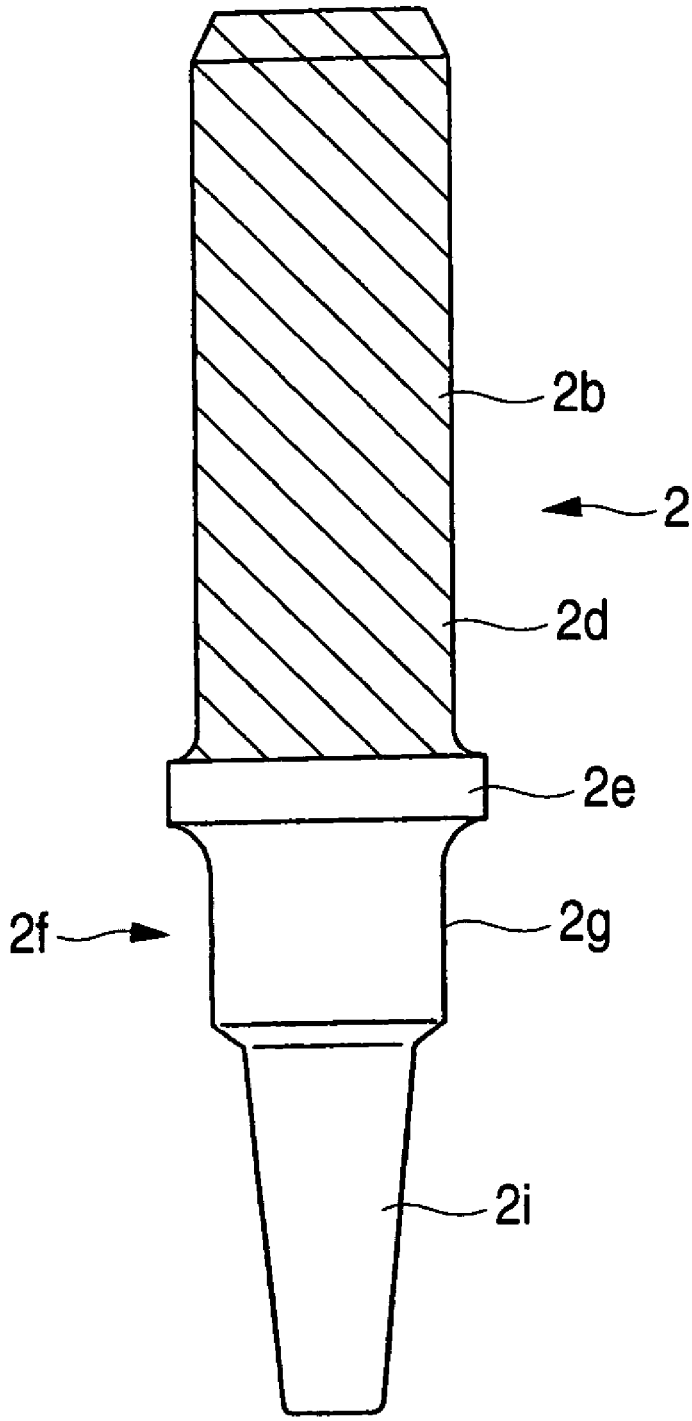

Next, on the surface of the insulator 2, actually as seen in FIG. 4, on the outer peripheral surface of a main body 2*b*, the glaze layer 2*d* is formed. The glaze layer 2*d* desirably is smooth at a maximum height Ry being 10 μm or less in a curve of a surface roughness of the glaze layer 2*d* in accordance to the measurement prescribed by JIS:B0601 at the outer periphery of the base portion of the main body 2*b*. The formed thickness is 10 to 150 μm, desirably 10 to 50 μm.

The spark plug 100 can be produced as follows.

At first, as to the insulator 2, an alumina powder is mixed with raw material powders of a Si component, Ca component, Mg component, Ba component, and B component such that a predetermined mixing ratio is obtained in the above mentioned composition in terms of oxides after sintering, and the mixed powder is mixed with a predetermined amount of a binder (e.g., PVA) and a water to form matrix granules, so that an original figure of the insulator is prepared, and this is baked at 1400 to 1600° C.

On the other hand, a glaze slurry is prepared as follows.

Figure 1:
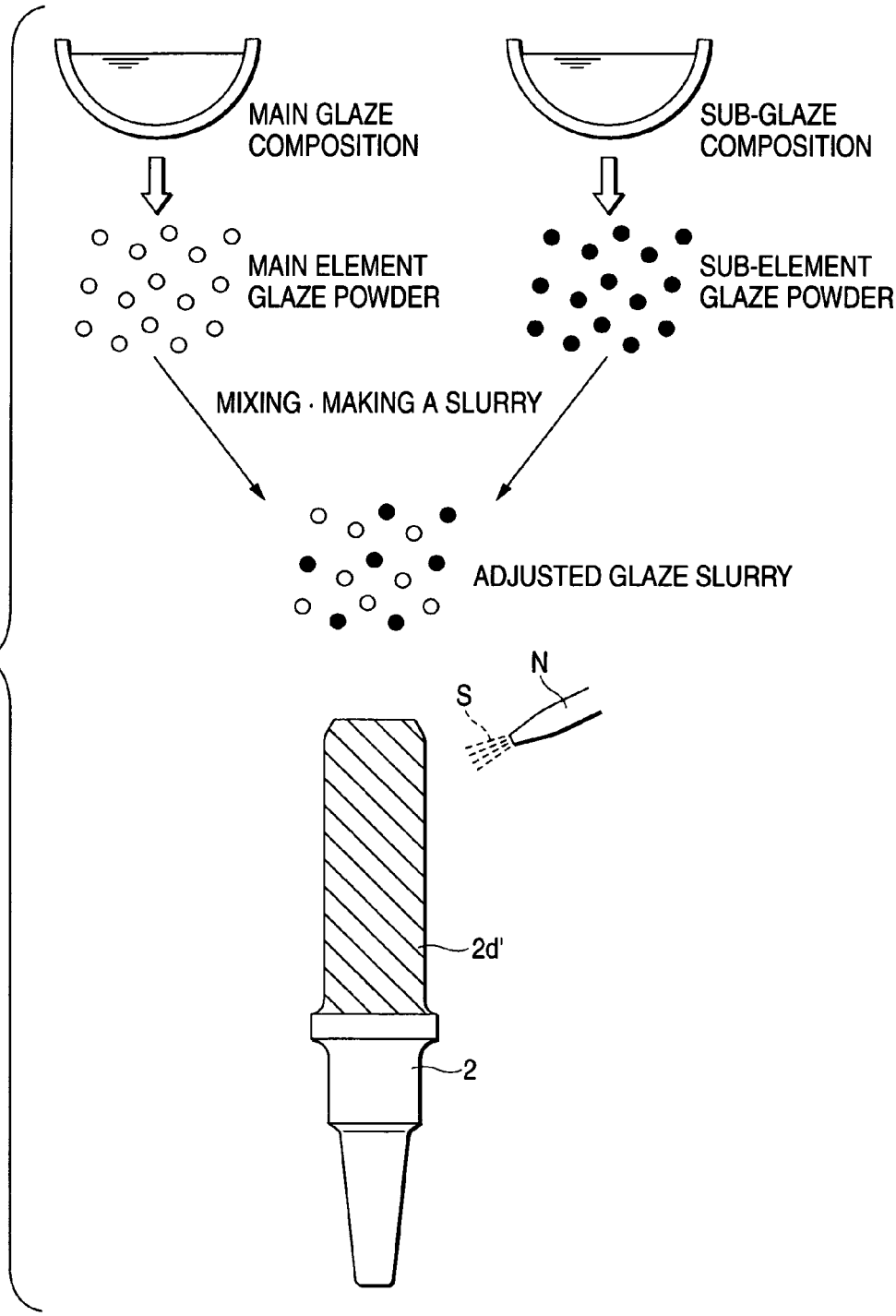
FIG. 1

At first, raw material powders as sources of Si, Al, B, Zn, Ba, Na, Ka and Li are prepared (for example, the Si component is $SiO_2$ powder, the Al component is $Al_2O_3$ powder, the B component is $H_3BO_3$ powder, the Zn component is ZnO powder, the Ba component is $BaCO_3$ powder, Na is $Na_2CO_3$ powder, K is $K_2CO_3$ powder, and Li is $Li_2CO_3$ powder). Then, as shown in FIG. 1, these substances are compounded and mixed such that the main and sub-glaze compositions are obtained respectively. Subsequently, the mixture is heated and melted at, e.g., 1000 to 1500° C., and thrown into the water to rapidly cool for vitrification, followed by grinding into fine pulverization of average diameter being, e.g., 5 to 45 μm to be the main and sub-glaze powders. These powders are compounded such that the sub-glaze powders become 5 to 30 weight %, and mixed with appropriate amounts of clay mineral such as kaolin or gairome clay and organic binder, and a water group solvent is added thereto to prepare the glaze slurry.

The adjusted glaze slurry is sprayed from a spray nozzle N to coat a required surface of the insulator 2, so that a glaze powder layer 2*d*' of an adjusted glaze powder is formed. By baking it after drying, the glaze powder layer 2*d*' becomes a glaze layer 2*d* as seen in FIG. 4.

As to the glaze powder layer of the adjusted glaze powder, as shown in FIG. 2A, the main element glaze powder having a lower dilatometric softening point is early softened and melted, and then formed with a liquid phase (herein, the first glaze powder corresponds to the main element glaze powder, while the second glaze powder corresponds to the sub-element glaze powder). At this time, if the earlier softened main element glaze powder (the first glaze powder) employs powders of the average smaller diameter (or those of larger specific surface value) than that of the sub-element glaze powder (the second glaze powder), the melting of the main element glaze powder can be accelerated when baking the glaze, and the fluidity at the glaze-baking can be more heightened.

In the thus produced glaze layer 2*d*, if determining the glaze-baking temperature to be enough high or the glaze-baking time to be long, the main glaze composition forming the main element glaze powder is uniformly mixed with the sub-glaze composition forming the sub-element glaze powder, and a simple glaze structure is produced as seen in FIG. 5B. However, if such a simplified phase occurs before accomplishing a smoothness owing to melting and fluidity of the glaze, a result is the same as using a non-adjusted glaze powder at the latter-half of the glaze-baking, so that the fluidity is spoiled and an enough smooth glaze layer might not be obtained (this results, for example, in bad external appearance or lowering the anti-flashover). Therefore, if a part of particles of the sub-element glaze powder which is adjusted in the composition for relatively heightening the dilatometric softening point, employs the glaze-baking temperature of insufficiently melting to cause the glaze to remain, the finally produced glaze layer can be, as shown in FIG. 5A, composed of the vitreous phase of a matrix glaze being the main of the glaze composition of the main element glaze powder and the dispersed glaze vitreous phase being the main of the glaze composition of the sub-element glaze powder. Thereby, a smoother glaze layer can be realized, and beside the dispersed glaze vitreous phase plays a role of an aggregate during the glaze-baking, and such inconveniences are difficult to occur that the glaze exceedingly flows to cause the glaze to drop or become uneven. Further, the average linear expansion coefficient of the glaze layer can be more lessened than the case of using the non-adjusted glaze powder, in turn resulting to obtain an effect of more reducing the difference of the linear expansion coefficient from the insulator.

The insulator 2 which is already coated with the glaze is set up with the metal shell 1 and a ground electrode 4, and the spark plug 100 is completed as shown in FIG. 3.

EXAMPLES

For confirming the effects of the invention, the under mentioned experiments were carried out.

The insulator 2 composed of alumina ceramic sintered substance embodied as shown in FIG. 3 was made through an ordinary process. Prepared raw materials were $SiO_2$ powder (purity: 99.5%), $Al_2O_3$ powder (purity: 99.5%), $H_3BO_3$ powder (purity: 98.5%), ZnO powder (purity: 99.5%), $BaSO_3$ powder (purity: 99.5%), SrO powder (purity: 99.5%), $Na_2CO_3$ powder (purity: 99.5%), $K_2CO_3$ powder (purity: 99%), $Li_2CO_3$ powder (purity: 99%), $MoO_3$ powder (purity: 99%), $Fe_2O_3$ powder (purity: 99%), $ZrO_2$ powder (purity: 99.5%), $TiO_2$ powder (purity: 99.5%), $CaCO_3$ powder (purity: 99.8%), MgO powder (purity: 99.5%), and $Bi_2O_3$ powder (purity: 99%). These substances were compounded at weight ratios with which the main element glaze powder A shown in Tables 1 and 2, the sub-element glaze powder B shown in Table 3, and the sub-element glaze powder C in Table 4 were to have the respective glaze compositions, heated to 1000 to 1500° C. and molten, and thrown into the water to rapidly cool for vitrification. Those were dried and pulverized to be below 50 μm by a ball mill using alumina made pot to turn out the glaze powders.

TABLE 1

| | 1 | 2 | 3 | 4 | 5 | 6 | 7 | 8 | 9 | 10 |
|---|---|---|---|---|---|---|---|---|---|---|
| $SiO_2$ | 33.4 | 25.0 | 33.9 | 21.8 | 39.8 | 42.0 | 30.0 | 28.0 | 34.5 | 39.4 |
| $Al_2O_3$ | 2.0 | 2.8 | 2.1 | 2.0 | 2.0 | 2.0 | 1.7 | 2.0 | 2.3 | 2.5 |
| $B_2O_3$ | 28.8 | 30.7 | 29.0 | 30.8 | 23.5 | 23.0 | 37.2 | 37.0 | 27.9 | 27.9 |
| $Na_2O$ | 0.8 | 0.3 | 0.9 | | 0.8 | 1.0 | 1.1 | 1.0 | 0.7 | 1.1 |
| $K_2O$ | 4.8 | 6.0 | 4.7 | 6.4 | 4.8 | 4.5 | 4.9 | 4.5 | 5.8 | 5.6 |
| $Li_2O$ | 2.0 | 2.0 | 2.0 | 2.0 | 2.0 | 2.0 | 2.2 | 2.0 | 2.3 | 2.3 |
| BaO | 4.5 | 4.7 | 4.7 | 4.8 | 4.5 | 4.5 | 4.9 | 4.5 | 4.5 | 5.6 |

TABLE 1-continued

| | 1 | 2 | 3 | 4 | 5 | 6 | 7 | 8 | 9 | 10 |
|---|---|---|---|---|---|---|---|---|---|---|
| SrO | | 1.3 | | | | | | | | |
| ZnO | 17.2 | 20.0 | 16.5 | 23.1 | 17.2 | 16.0 | 12.2 | 16.0 | 14.7 | 8.1 |
| $MoO_3$ | 1.1 | 1.3 | 1.0 | 1.5 | 1.1 | 1.0 | 1.1 | 1.0 | 1.3 | 1.3 |
| $Fe_2O_3$ | | | | | | | | | | |
| CaO | 4.3 | 4.7 | 4.2 | 6.2 | 3.2 | 3.0 | 3.3 | 3.0 | 2.7 | 5.0 |
| $ZrO_2$ | 1.1 | 1.3 | 1.0 | 1.5 | 1.1 | 1.0 | 1.1 | 1.0 | 1.3 | 1.3 |
| $TiO_2$ | | | | | | | | | 0.7 | |
| MgO | | | | | | | | | 1.3 | |
| Total; | 100 | 100 | 100 | 100 | 100 | 100 | 100 | 100 | 100 | 100 |
| K/(Na + Li + K) | 0.63 | 0.72 | 0.62 | 0.76 | 0.63 | 0.60 | 0.60 | 0.60 | 0.66 | 0.63 |
| Li/(Na + Li + K) | 0.26 | 0.24 | 0.26 | 0.24 | 0.26 | 0.27 | 0.27 | 0.27 | 0.26 | 0.00 |
| ZnO + BaO/SrO | 21.7 | 26.0 | 21.2 | 27.8 | 21.7 | 20.5 | 17.1 | 20.5 | 19.2 | 13.8 |
| Coefficient of thermal expansion × $10^{-6}$ | 7.10 | 7.35 | 7.15 | 7.40 | 7.10 | 6.95 | 7.30 | 7.15 | 7.10 | 7.20 |
| Dilatometric softening point | 565 | 560 | 560 | 545 | 565 | 570 | 555 | 550 | 570 | 580 |

TABLE 2

| | Main element glaze powder A | | | | | | | | | |
|---|---|---|---|---|---|---|---|---|---|---|
| | 11 | 12 | 13 | 14 | 15 | 16 | 17 | 18 | 19 | 20 |
| $SiO_2$ | 36.3 | 35.6 | 34.6 | 35.5 | 33.3 | 36.1 | 37.3 | 38.0 | 41.8 | 39.8 |
| $Al_2O_3$ | 2.1 | 2.5 | 2.5 | 2.1 | 2.0 | 2.1 | 2.4 | 1.5 | 2.2 | 2.2 |
| $B_2O_3$ | 28.2 | 26.6 | 27.2 | 26.6 | 28.7 | 29.3 | 27.6 | 29.9 | 29.2 | 27.6 |
| $Na_2O$ | 1.0 | 1.1 | 0.8 | 1.4 | 0.3 | 0.9 | 1.2 | 1.0 | 0.6 | 0.6 |
| $K_2O$ | 4.7 | 4.4 | 6.4 | 5.2 | 5.1 | 4.8 | 4.7 | 4.1 | 3.5 | 3.3 |
| $Li_2O$ | 2.1 | 2.3 | 2.5 | 2.6 | 1.7 | 2.0 | 2.4 | 0.4 | 1.8 | 1.1 |
| BaO | 4.7 | 5.6 | 5.7 | 3.1 | 4.5 | 4.1 | 4.9 | 4.6 | 2.7 | 5.0 |
| SrO | | | | | | | | | | |
| ZnO | 14.7 | 19.4 | 12.9 | 18.5 | 17.3 | 15.2 | 12.7 | 15.7 | 11.2 | 13.8 |
| $MoO_3$ | 1.0 | 1.3 | 1.5 | 1.1 | 1.3 | 1.1 | 1.2 | 1.2 | 1.2 | 1.1 |
| $Fe_2O_3$ | 0.5 | | | | | | | | | |
| CaO | | | 4.4 | 2.2 | 4.5 | 3.3 | 4.1 | 3.0 | 4.7 | 4.4 |
| $ZrO_2$ | 1.0 | 1.3 | 1.5 | 1.1 | 1.3 | | 1.2 | 0.6 | 1.2 | 1.1 |
| $TiO_2$ | | | | 0.5 | | 1.1 | | | | |
| MgO | 3.6 | | | | | | | | | |
| Total; | 100 | 100 | 100 | 100 | 100 | 100 | 100 | 100 | 100 | 100 |
| K/(Na + Li + K) | 0.60 | 0.56 | 0.66 | 0.57 | 0.72 | 0.62 | 0.57 | 0.75 | 0.60 | 0.67 |
| Li/(Na + Li + K) | 0.27 | 0.29 | 0.26 | 0.28 | 0.24 | 0.26 | 0.29 | 0.08 | 0.31 | 0.22 |
| ZnO + BaO/SrO | 19.4 | 25.0 | 18.7 | 21.6 | 21.8 | 19.3 | 17.6 | 20.3 | 13.9 | 18.8 |
| Coefficient of thermal expansion × $10^{-6}$ | 7.05 | 6.95 | 7.10 | 7.10 | 7.10 | 7.10 | 6.95 | 7.15 | 7.00 | 7.05 |
| Dilatometric softening point | 565 | 585 | 570 | 565 | 570 | 565 | 570 | 575 | 580 | 575 |

TABLE 3

| | Sub-element glaze powder B | | | | | | | |
|---|---|---|---|---|---|---|---|---|
| | 1 | 2 | 3 | 4 | 5 | 6 | 7 | 8 |
| $SiO_2$ | 71.0 | 75.0 | 65.0 | 68.0 | 50.0 | 83.0 | 73.0 | 60.0 |
| $Al_2O_3$ | 2.0 | | 1.0 | 0.5 | 2.0 | | 0.5 | 0.5 |
| $B_2O_3$ | 17.0 | 16.0 | 15.0 | 16.0 | 21.0 | 12.0 | 8.0 | 26.0 |
| $Na_2O$ | 3.0 | 3.0 | 3.0 | 1.5 | 3.5 | 2.0 | 2.0 | 2.0 |
| $K_2O$ | 1.0 | | 4.0 | 1.0 | | 1.0 | 1.0 | 1.0 |
| $Li_2O$ | 2.0 | 2.0 | 2.5 | 1.0 | 3.0 | 2.0 | 1.5 | 1.6 |
| BaO | 4.0 | | 9.5 | 8.0 | 4.5 | | 6.0 | 9.0 |
| ZnO | | 4.0 | | 4.0 | 16.0 | | 8.0 | |
| Total; | 100 | 100 | 100 | 100 | 100 | 100 | 100 | 100 |
| Coefficient of thermal expansion × $10^{-6}$ | 4.8 | 4.6 | 5.8 | 4.2 | 5.4 | 4.6 | 4.9 | 5.2 |
| Dilatometric softening point | 580 | 590 | 560 | 670 | 570 | 680 | 670 | 565 |

TABLE 4

| | Sub-element glaze powder C | | | | | |
|---|---|---|---|---|---|---|
| | 9 | 10 | 11 | 12 | 13 | 14 |
| $SiO_2$ | 5.0 | 10.0 | 2.0 | 15.0 | 10.0 | 2.0 |
| $Al_2O_3$ | | | | 1.0 | 1.0 | |
| $B_2O_3$ | 35.0 | 31.0 | 30.0 | 40.0 | 28.0 | 52.0 |
| $Na_2O$ | | 0.5 | | | 3.5 | |
| $K_2O$ | | | | | | |
| $Li_2O$ | | 1.0 | | | 3.0 | |
| BaO | | | | 4.0 | 4.5 | |
| ZnO | 60.0 | 57.5 | 68.0 | 40.0 | 50.0 | 46.0 |
| Total; | 100 | 100 | 100 | 100 | 100 | 100 |
| Coefficient of thermal expansion × $10^{-6}$ | 4.6 | 4.8 | 4.5 | 5.4 | 4.9 | 5.1 |
| Dilatometric softening point | 590 | 580 | 575 | 615 | 635 | 560 |

The respective main element glaze powders were mixed with the respective sub-element glaze powders at the weight ratios shown in Tables 3 to 5 (No. 5 in Table 3 is a comparative example of mixing with no sub-element glaze powder). To 100 weight parts of the mixture, 3 parts by weight of New Zealand kaolin and 2 parts by weight of PVA as an organic binder were mixed, and the mixture was kneaded with 100 weight parts of the water to prepare the glaze slurry (the adjusted glaze powder).

The above mentioned glaze slurry was sprayed on the insulator 2 from the spray nozzle, and dried to form the coated layer of the glaze slurry. The insulator 2 was immersed in the bath where the glaze slurry was thrown, and pulled up to form the glaze layer on the surface of the insulator 2. The coated thickness of the dried glaze was around 100 μm. The insulator 2 was subjected to the glaze-baking at 900° C. for 30 minutes, and the formed state of the obtained glaze layer 2*d* was visually observed.

The thermal shock resistance was evaluated as follows. The test that, the non-glaze coated part was covered with a silicone tube, kept at a constant temperature T (° C) higher than a room temperature in a chamber at high temperature, and thrown into a water at 20° C., was repeated as gradually increasing the keeping temperature, and the temperature T when cracks began in the glaze layer was measured, thereby to determine the difference T−20° C. of a limited cooling temperature. The chipping resistance of the glaze layer was evaluated as follows. The spark plug 100 was produced and the chip test was performed. That is, an attaching screw portion 7 of the spark plug was screwed into a threaded hole of a securing bed of the test piece, so that a main portion 2*b* of the insulator 2 was turned upward. At a further upper part of the main portion 2*b*, an arm was swingably provided to an axial fulcrum positioned on a center axial line O of the insulator 2. By the way, the length of the arm was 330 mm, and the axial fulcrum was positioned such that a front end of the arm, when the arm was brought down to a rear side main portion of the insulator 2, was 10 mm at a distance in a vertical direction from a rear side of the insulator 2. By repeating an operation, at angular distance of 2° as opening the angle, that the front end of the arm was pulled up such that a turning angle from the center axial line O was at a predetermined angle, an angular value θ of the chip resistance was demanded.

On the other hand, using the respective element glaze powders and the glazes where the slurry was subjected to dehydration press to turn out dried powders, the following experiments were carried out.

① Linear expansion coefficient: The specimen of 5 mm×5 mm×5 mm was cut out from the block-like sample, and measured with the known dilatometer method at the temperature ranging 20 to 350° C. The same measurement was made at the same size of the specimen cut out from the insulator 2. As a result, the value was $73\times10^{-7}$/° C.

② Dilatometric softening point: The powder sample weighing 50 mg was subjected to the differential thermal analysis, and the heating was measured from a room temperature. The second endothermic peal was taken as the dilatometric softening point.

The above results are shown in Table 5 to 8. In Tables, generally, "○" means "good" and "Δ" means "not so good".

TABLE 5

| Number; | 1 | 2 | 3 | 4 | 5 | 6 |
|---|---|---|---|---|---|---|
| A | | | | | | |
| Vitreous composition No. | A-1 | A-2 | A-3 | A-4 | A-5 | A-5 |
| Mixing ratio(%) | 93% | 75% | 96% | 65% | 93% | 93% |
| B | | | | | | |
| Vitreous composition No. | B-1 | B-2 | B-2 | B-1 | B-1 | B-4 |
| Mixing ratio (%) | 7% | 25% | 4% | 35% | 7% | 7% |
| C | | | | | | |
| Vitreous composition No. | — | — | — | — | — | — |
| Mixing ratio(%) | 0% | 0% | 0% | 0% | 0% | 0% |
| D | | | | | | |
| $SiO_2$ | 36.0 | 37.5 | 35.5 | 39.0 | 42.0 | 41.8 |
| $Al_2O_3$ | 2.0 | 2.0 | 2.0 | 2.0 | 2.0 | 1.9 |
| $B_2O_3$ | 28.0 | 27.0 | 28.5 | 26.0 | 23.0 | 22.9 |
| $Na_2O$ | 1.0 | 1.0 | 1.0 | 1.0 | 1.0 | 0.9 |
| $K_2O$ | 4.5 | 4.5 | 4.5 | 4.5 | 4.5 | 4.5 |
| $Li_2O$ | 2.0 | 2.0 | 2.0 | 2.0 | 2.0 | 1.9 |
| BaO | 4.5 | 3.5 | 4.5 | 4.5 | 4.5 | 4.8 |
| SrO | | 1.0 | | | | |

TABLE 5-continued

| Number; | 1 | 2 | 3 | 4 | 5 | 6 |
|---|---|---|---|---|---|---|
| ZnO | 16.0 | 16.0 | 16.0 | 15.0 | 16.0 | 16.3 |
| $MoO_3$ | 1.0 | 1.0 | 1.0 | 1.0 | 1.0 | 1.0 |
| $Fe_2O_3$ | | | | | | |
| CaO | 4.0 | 3.5 | 4.0 | 4.0 | 3.0 | 3.0 |
| $ZrO_2$ | 1.0 | 1.0 | 1.0 | 1.0 | 1.0 | 1.0 |
| $TiO_2$ | | | | | | |
| MgO | | | | | | |
| Total; | 100 | 100 | 100 | 100 | 100 | 100 |
| K/(Na + Li + K) | 0.60 | 0.60 | 0.60 | 0.60 | 0.60 | 0.61 |
| Li/(Na + Li + K) | 0.27 | 0.27 | 0.27 | 0.27 | 0.27 | 0.26 |
| ZnO + BaO/SrO | 20.5 | 20.5 | 20.5 | 19.5 | 20.5 | 21.1 |
| Linear expansion coefficient × $10^{-6}$ | 6.70 | 6.50 | 6.70 | 6.30 | 7.00 | 6.30 |
| Dilatometric softening point | 575 | 580 | 570 | 605 | 570 | 605 |
| External appearance | ○ | ○ | ○ | Δ E | ○ | Δ E |
| Thermal shock resistance (Crack appearing temp. ΔT) | 240° C. | 250° C. | 200° C. | 240° C. | 230° C. | 210° C. |
| Chipping resistance | 44° | 46° | 36° | 34° | 44° | 38° |
| Void number (pieces) in the glaze layer | 15 | 10 | 25 | 35 | 10 | 30 |
| Special remark; | | | | | | |

(Unit mol %: * is out of the inventive range;)
A: Main element glaze powder A;
B: Sub-element glaze powder B;
C: Sub-element glaze powder C;
D: Composition of the glaze powders after mixing
E: A little insufficient glaze-melting

TABLE 6

| Number; | 7 | 8 | 9* | 10 | 11* | 12 |
|---|---|---|---|---|---|---|
| A | | | | | | |
| Vitreous composition No. | A-5 | A-5 | A-6 | A-7 | A-B | A-9 |
| Mixing ratio(%) | 93% | 93% | 100% | 92% | 100% | 75% |
| B | | | | | | |
| Vitreous composition No. | B-6 | B-7 | — | — | — | B-1 |
| Mixing ratio (%) | 7% | 7% | 0% | 0% | 0% | 15% |
| C | | | | | | |
| Vitreous composition No. | — | — | — | C-9 | — | C-9 |
| Mixing ratio (%) | 0% | 0% | 0% | 8% | 0% | 10% |
| D | | | | | | |
| $SiO_2$ | 42.8 | 42.1 | 42.0 | 28.0 | 28.0 | 37.0 |
| $Al_2O_3$ | 1.9 | 1.9 | 2.0 | 2.0 | 2.0 | 2.0 |
| $B_2O_3$ | 22.7 | 22.4 | 23.0 | 37.0 | 37.0 | 27.0 |
| $Na_2O$ | 0.9 | 0.9 | 1.0 | 1.0 | 1.0 | 1.0 |
| $K_2O$ | 4.5 | 4.5 | 4.5 | 4.5 | 4.5 | 4.5 |
| $Li_2O$ | 2.0 | 2.0 | 2.0 | 2.0 | 2.0 | 2.0 |
| BaO | 4.2 | 4.6 | 4.5 | 4.5 | 4.5 | 4.0 |
| SrO | | | | | | |
| ZnO | 16.0 | 16.6 | 16.0 | 16.0 | 16.0 | 17.0 |
| $MoO_3$ | 1.0 | 1.0 | 1.0 | 1.0 | 1.0 | 1.0 |
| $Fe_2O_3$ | | | | | | |
| CaO | 3.0 | 3.0 | 3.0 | 3.0 | 3.0 | 2.0 |
| $ZrO_2$ | 1.0 | 1.0 | 1.0 | 1.0 | 1.0 | 1.0 |
| $TiO_2$ | | | | | | 0.5 |
| MgO | | | | | | 1.0 |
| Total; | 100 | 100 | 100 | 100 | 100 | 100 |
| K/(Na + Li + K) | 0.61 | 0.61 | 0.60 | 0.60 | 0.60 | 0.60 |
| Li/(Na + Li + K) | 0.27 | 0.27 | 0.27 | 0.27 | 0.27 | 0.27 |
| ZnO + BaO/SrO | 20.2 | 21.2 | 20.5 | 20.5 | 20.5 | 21.0 |
| Linear expansion coefficient × $10^{-6}$ | 6.40 | 6.40 | 6.95 | 7.20 | 7.15 | 6.40 |
| Dilatometric softening point | 610 | 610 | 570 | 550 | 550 | 585 |
| External appearance | Δ E | Δ E | ○ | ○ | ○ | ○ |

TABLE 6-continued

| Number; | 7 | 8 | 9* | 10 | 11* | 12 |
|---|---|---|---|---|---|---|
| Thermal shock resistance (Crack appearing temp. ΔT) | 200° C. | 210° C. | 180° C. | 220° C. | 170° C. | 240° C. |
| Chipping resistance | 34° | 38° | 30° | 40° | 28° | 44° |
| Void number (pieces) in the glaze layer | 35 | 30 | 45 | 25 | 55 | 10 |
| Special remark; | | | H Non | | H Non | |

(Unit mol %: * is out of the inventive range;)
A: Main element glaze powder A;
B: Sub-element glaze powder B;
C: Sub-element glaze powder C;
D: Composition of the glaze powders after mixing
E: A little insufficient glaze-melting
H: Glass mixing

TABLE 7

| Number; | 13 | 14 | 15 | 16 | 17 | 18 |
|---|---|---|---|---|---|---|
| A | | | | | | |
| Vitreous composition No. | A-10 | A-11 | A-12 | A-13 | A-14 | A-15 |
| Mixing ratio(%) | 80% | 96% | 80% | 68% | 91% | 78% |
| B | | | | | | |
| Vitreous composition No. | — | — | — | B-1 | B-3 | B-5 |
| Mixing ratio (%) | 0% | 0% | 0% | 15% | 7% | 22% |
| C | | | | | | |
| Vitreous composition No. | C-10 | C-9 | C-10 | C-9 | C-9 | — |
| Mixing ratio (%) | 20% | 4% | 20% | 17% | 2% | 0% |
| D | | | | | | |
| $SiO_2$ | 33.5 | 35.0 | 30.5 | 35.0 | 37.0 | 37.0 |
| $Al_2O_3$ | 2.0 | 2.0 | 2.0 | 2.0 | 2.0 | 2.0 |
| $B_2O_3$ | 28.5 | 28.5 | 27.5 | 27.0 | 26.0 | 27.0 |
| $Na_2O$ | 1.0 | 1.0 | 1.0 | 1.0 | 1.5 | 1.0 |
| $K_2O$ | 4.5 | 4.5 | 3.5 | 4.5 | 5.0 | 4.0 |
| $Li_2O$ | 2.0 | 2.0 | 2.0 | 2.0 | 2.5 | 2.0 |
| BaO | 4.5 | 4.5 | 4.5 | 4.5 | 3.5 | 4.5 |
| SrO | | | | | | |
| ZnO | 18.0 | 16.5 | 27.0 | 19.0 | 18.0 | 17.0 |
| $MoO_3$ | 1.0 | 1.0 | 1.0 | 1.0 | 1.0 | 1.0 |
| $Fe_2O_3$ | | 0.5 | | | | |
| CaC | 4.0 | | 0.0 | 3.0 | 2.0 | 3.5 |
| $ZrO_2$ | 1.0 | 1.0 | 1.0 | 1.0 | 1.0 | 1.0 |
| $TiO_2$ | | | | | 0.5 | |
| MgO | | 3.5 | | | | |
| Total; | 100 | 100 | 100 | 100 | 100 | 100 |
| K/(Na + Li + K) | 0.60 | 0.60 | 0.54 | 0.60 | 0.56 | 0.57 |
| Li/(Na + Li + K) | 0.27 | 0.27 | 0.31 | 0.27 | 0.28 | 0.29 |
| ZnC + BaO/SrO | 22.5 | 21.0 | 31.5 | 23.5 | 21.5 | 21.5 |
| Linear expansion coefficient × $10^{-6}$ | 6.50 | 7.00 | 6.20 | 6.20 | 6.95 | 6.90 |
| Dilatometric softening point | 580 | 570 | 595 | 600 | 575 | 580 |
| External appearance | ○ | ○ | Δ F | Δ E | ○ | ○ |
| Thermal shock resistance (Crack appearing temp. ΔT) | 260° C. | 200° C. | 250° C. | 240° C. | 200° C. | 210° C. |
| Chipping resistance | 46° | 38° | 42° | 38° | 40° | 42° |
| Void number (pieces) in the glaze layer | 2S | 35 | 30 | 25 | 20 | |
| Special remark; | | | G | | | |

(Unit mol %: * is out of the inventive range;)
A: Main element glaze powder A;
B: Sub-element glaze powder B;
C: Sub-element glaze powder C;
D: Composition of the glaze powders after mixing
E: A little insufficient glaze-melting
F: A little de-vitrification
G: A little dropping (uneven coating)

TABLE 8

| Number; | 19 | 20 | 21 | 22 | 23 |
|---|---|---|---|---|---|
| A | | | | | |
| Vitreous composition No. | A-16 | A-17 | A-18 | A-19 | A-20 |
| Mixing ratio(%) | 92% | 85% | 83% | 85% | 90% |
| B | | | | | |
| Vitreous composition No. | B-8 | — | B-1 | — | — |
| Mixing ratio(%) | 8% | 0% | 7% | 0% | 0% |
| C | | | | | |
| Vitreous composition No. | — | C-11 | C-12 | C-13 | C-14 |
| Mixing ratio(%) | 0% | 15% | 10% | 15% | 10% |
| D | | | | | |
| $SiO_2$ | 38.0 | 32.0 | 38.0 | 37.0 | 36.0 |
| $Al_2O_3$ | 2.0 | 2.0 | 1.5 | 2.0 | 2.0 |
| $B_2O_3$ | 29.0 | 28.0 | 30.0 | 29.0 | 30.0 |
| $Na_2O$ | 1.0 | 1.0 | 1.0 | 1.0 | 0.5 |
| $K_2O$ | 4.5 | 4.0 | 3.5 | 3.0 | 3.0 |
| $Li_2O$ | 2.0 | 2.0 | 0.5 | 2.0 | 1.0 |
| BaO | 4.5 | 4.5 | 4.5 | 3.0 | 4.5 |
| SrO | | | | | |
| ZnO | 14.0 | 21.0 | 17.0 | 17.0 | 17.0 |
| $MoO_3$ | 1.0 | 1.0 | 1.0 | 1.0 | 1.0 |
| $Fe_2O_3$ | | | | | |
| CaO | 3.0 | 3.5 | 2.5 | 4.0 | 4.0 |
| $ZrO_2$ | | 1.0 | 0.5 | 1.0 | 1.0 |
| $TiO_2$ | 1.0 | | | | |
| MgO | | | | | |
| Total; | 100 | 100 | 100 | 100 | 100 |
| K/(Na + Li + K) | 0.60 | 0.57 | 0.70 | 0.50 | 0.67 |
| Li/(Na + Li + K) | 0.27 | 0.29 | 0.10 | 0.33 | 0.22 |
| ZnO + BaO/SrO | 18.5 | 25.5 | 21.5 | 20.0 | 21.5 |
| Linear expansion coefficient × $10^{-6}$ | 7.00 | 6.50 | 6.90 | 6.90 | 6.95 |
| Dilatometric softening point | 570 | 580 | 585 | 585 | 580 |
| External appearance | ○ | Δ F | Δ E | Δ E | ○ |
| Thermal shock resistance (Crack appearing temp. ΔT) | 200° C. | 240° C. | 200° C. | 210° C. | 200° C. |
| Chipping resistance | 380 | 340 | 380 | 400 | 380 |
| Void number (pieces) in the glaze layer | 25 | 35 | 30 | 25 | 30 |
| Special remark; | | G | | | |

(Unit mol % * is out of the inventive range;)
A: Main element glaze powder A;
B: Sub-element glaze powder B;
C: Sub-element glaze powder C;
D: Composition of the glaze powders after mixing
E: A little insufficient glaze-melting
F: A little de-vitrification
G: A little dropping (uneven coating)

As apparently from the results, by using the adjusted glaze powders where the main element glaze powders are mixed with the sub-element glaze powders, it is seen that the thermal chip resistance and the chipping resistance of the glaze layer are remarkably improved in comparison with the glazes using the non-adjusted glaze powder (Table 6: Nos. 9 and 11).

This application is based on Japanese Patent application JP 2001-193094, filed Jun. 26, 2001, the entire content of which is hereby incorporated by reference, the same as if set forth at length.

What is claimed is:

1. A method for producing a spark plug, the spark plug comprising a center electrode, a metal shell and an alumina ceramic insulator disposed between the center electrode and the metal shell, wherein at least part of the surface of the insulator is covered with a glaze layer, the method comprising the steps of:

melting, vitrifying and grinding a first and a second mixture of raw material powders respectively so as to prepare a first element glaze powder and a second element glaze powder, the second element glaze powder having a higher dilatometric softening point than that of the first element glaze powder;

coating the surface of the insulator at least partially with the first and second element glaze powders so as to form a glaze powder layer; and baking the glaze powder layer to the surface of the insulator so as to form the glaze layer by heating the glaze powder layer.

2. The method of claim 1, wherein the second element glaze powder comprises a larger amount of Si in terms of $SiO_2$ than that of the first element glaze powder.

3. The method of claim 1, wherein the second element glaze powder comprises a larger amount of Zn in terms of ZnO than that of the first element glaze powder.

4. The method of claim 1, wherein the first element glaze powder has a smaller average diameter than that of the second element glaze powder.

5. The method of claim 1, which further comprises the step of mixing the first and second element glaze powders before the coating step.

6. The method of claim 1, wherein the glaze layer has at least part of the second element glaze powder remaining incompletely fused.

7. A method for producing a spark plug, the spark plug comprising a center electrode, a metal shell and an alumina ceramic insulator disposed between the center electrode and the metal shell, wherein at least part of the surface of the insulator is covered with a glaze layer, the method comprising the steps of:

melting, vitrifying and grinding a first and a second mixture of raw material powders respectively so as to prepare a first element glaze powder and a second element glaze powder, the second element glaze powder having a smaller linear expansion coefficient than that of the first element glaze powder;

coating the surface of the insulator at least partially with the first and second element glaze powders so as to form a glaze powder layer; and baking the glaze powder layer to the surface of the insulator so as to form the glaze layer by heating the glaze powder layer.

8. The method of claim 7, wherein the second element glaze powder comprises a larger amount of Si in terms of $SiO_2$ than that of the first element glaze powder.

9. The method of claim 7, wherein the second element glaze powder comprises a larger amount of Zn in terms of ZnO than that of the first element glaze powder.

10. The method of claim 7, which further comprises the step of mixing the first and second element glaze powders before the coating step.

11. The method of claim 7, wherein the glaze layer has at least part of the second element glaze powder remaining incompletely fused.

12. A method for producing a spark plug, the spark plug comprising a center electrode, a metal shell and an alumina ceramic insulator disposed between the center electrode and the metal shell, wherein at least part of the surface of the insulator is covered with a glaze layer, the method comprising the steps of:

melting, vitrifying and grinding a plurality of different mixtures of raw material powders respectively so as to prepare a plurality of different element glaze powders wherein each different element glaze powder has a different dilatometric softening point and a different linear expansion coefficient compared to the other element glaze powders;

coating the surface of the insulator at least partially with the plurality of different element glaze powders so as to form a glaze powder layer; and baking the glaze powder layer to the surface of the insulator so as to form the glaze layer by heating the glaze powder layer.

13. The method of claim 12, further comprising the step of mixing the plurality of different element glaze powders before the coating step.

14. The method of claim 12, wherein the glaze layer is formed so that the glaze layer comprises 1 mol % or less of Pb in terms of PbO.

15. The method of claim 12, wherein the element glaze powders comprise a main glaze composition and a sub-glaze composition, wherein the amount of at least one of an Si component in terms of $SiO_2$ and a Zn component in terms of ZnO is different between the main glaze composition and the sub-glaze composition, and wherein the sub-glaze composition has a lower linear expansion coefficient than that of the main glaze composition and has a higher dilatometric softening point than that of the main glaze composition.

16. The method of claim 12, further comprising the step of adjusting a composition of the plurality of different element glaze powders so that a linear expansion coefficient of the glaze layer is $50\times10^{-7}$/° C. to $85\times10^{-7}$/° C.

17. The method of claim 15, wherein the glaze layer is formed so that the glaze layer comprises 1 mol % or less of Pb in terms of PbO, the main glaze composition comprises:

25 to 45 mol % of a Si component in terms of $SiO_2$;

20 to 40 mol % of a B component in terms of $B_2O_3$;

5 to 25 mol % of a Zn component in terms of ZnO;

0.5 to 15 mol % in total of at least one of Ba and Sr components in terms of BaO and SrO respectively; and 5 to 10 mol % in total of at least one of alkaline metal components of Na, K and Li in terms of $Na_2O$, $K_2O$, and $Li_2O$, respectively, the sub-glaze composition comprises one of:

a first sub-glaze composition comprising 60 to 80 mol % of a Si component in terms of $SiO_2$, 10 to 25 mol % of a B component in terms of $B_2O_3$ and 4 to 8 mol % in total of at least one of alkaline metal components of Na, K and Li in terms of $Na_2O$, $K_2O$, and $Li_2O$, respectively; and a second sub-glaze composition comprising 45 to 65 mol % of a Zn component in terms of ZnO and 30 to 50 mol % of a B component in terms of $B_2O_3$, and the method further comprises the step of mixing the element glaze powder of the main glaze composition with the element glaze powder of the sub-glaze composition.

18. The method of claim 17, wherein the plurality of different element glaze powders in the preparing step comprises 5 to 30% by weight of the sub-element glaze powder.

19. The method of claim 17, wherein the sub-element glaze composition has a linear expansion coefficient of $50\times10^{-7}$/° C. or less.

20. The method of claim 17, wherein the element glaze powder of the main glaze composition has a smaller average diameter than that of the element glaze powder of the sub-glaze composition.

21. A method for producing a spark plug, the spark plug comprising a center electrode, a metal shell and an alumina ceramic insulator disposed between the center electrode and metal shell, wherein at least a part of the surface of the insulator is covered with a glaze layer, the method comprising the steps of:

preparing a first element glaze powder and a second element glaze powder;

mixing the first element glaze powder and the second element glaze powder;

coating the surface of the insulator at least partially with the first and second element glaze powders so as to form a glaze powder layer; and baking the glaze powder layer to the surface of the insulator so as to form the glaze layer by heating the glaze powder layer, wherein the first element glaze powder comprises:

25 to 45 mol % of an Si component in terms of $SiO_2$;

20 to 40 mol % of a B component in terms of $B_2O_3$;

5 to 25 mol % of a Zn component in terms of ZnO;

0.5 to 15 mol % in total of least one of a Ba and an Sr component in terms of BaO and SrO, respectively; and 5 to 10 mol % in total of at least one of alkaline metal components of Na, K, and Li in terms of $Na_2O$, $K_2O$, and $Li_2O$, respectively, and the second element glaze powder comprises one of:

a first composition comprising 60 to 80 mol % of an Si component in terms of $Si_2O_2$, 10 to 25 mol % of a B component in terms of $B_2O_3$, and 4 to 8 mol % in total of at least one of alkaline metal components of Na, K, and Li in terms of $Na_2O$, $K_2O$, and $Li_2O$, respectively; and a second composition comprising 45 to 65 mol % of a Zn component in terms of ZnO and 30 to 50 mol % of a B component in terms of $B_2O_3$.

* * * * *